US008635797B2

(12) United States Patent
Cha et al.

(10) Patent No.: US 8,635,797 B2
(45) Date of Patent: Jan. 28, 2014

(54) RIFLING ANGLE CALCULATING METHOD

(75) Inventors: Ki Up Cha, Daejeon (KR); Young Hyun Lee, Daejeon (KR); Chang Ki Cho, Daejeon (KR)

(73) Assignee: Agency for Defense Development, Daejeon (KR)

( * ) Notice: Subject to any disclaimer, the term of this patent is extended or adjusted under 35 U.S.C. 154(b) by 83 days.

(21) Appl. No.: 13/358,796

(22) Filed: Jan. 26, 2012

(65) Prior Publication Data

US 2012/0192475 A1 Aug. 2, 2012

(30) Foreign Application Priority Data

Jan. 31, 2011 (KR) ..... 10-2011-0009566

(51) Int. Cl.
*F41A 21/18* (2006.01)

(52) U.S. Cl.
USPC ..... 42/78; 42/76.1; 89/14.7

(58) Field of Classification Search
USPC ..... 42/78, 76.1; 89/14.7
See application file for complete search history.

(56) References Cited

U.S. PATENT DOCUMENTS

| | | | | |
|---|---|---|---|---|
| 4,924,614 | A * | 5/1990 | Hoffmann et al. | 42/78 |
| 5,077,926 | A | 1/1992 | Krumm | |
| 5,337,504 | A * | 8/1994 | Krumm | 42/78 |
| 6,170,187 | B1 * | 1/2001 | Herrmann et al. | 42/78 |
| 6,739,083 | B2 * | 5/2004 | Martin | 42/78 |
| 7,802,394 | B1 * | 9/2010 | Bartoli | 42/78 |

* cited by examiner

*Primary Examiner* — Samir Abdosh
*Assistant Examiner* — Benjamin Gomberg
(74) *Attorney, Agent, or Firm* — Harness, Dickey & Pierce, P.L.C.

(57) ABSTRACT

A rifling angle calculating method according to the present invention expands a rifling angle by combining a Fourier function and a polynomial function to take only the advantages of the two functions, and thus boundary conditions at the start and end points of the rifling angle may be faithfully satisfied, and an optimum rifling angle for minimizing the maximum rifling force may be calculated.

4 Claims, 3 Drawing Sheets

RIFLING ANGLE CALCULATING METHOD

CROSS REFERENCE TO RELATED APPLICATION

This application claims the benefit of Korean Patent Application No. 10-2011-0009566 filed Jan. 31, 2011, the entire disclosure of which is incorporated herein by reference.

BACKGROUND OF THE INVENTION

1. Field of the Invention

The present invention relates to a rifling angle calculating method, and more specifically, to a rifling angle calculating method capable of minimizing the maximum value of rifling force generated when a gun is fired, by expanding the rifling angle into a function of length of gun barrel.

2. Background of the Related Art

A rifling angle α is an angle expressing a shape y of rifling along the direction of length x of a gun barrel, which can be expressed in mathematical expression 1 shown below.

[mathematical expression 1]

$$\tan\alpha = \frac{dy}{dx}$$

Conventionally, rifling is designed by stabilizing twist rate $$\frac{dy}{dx}$$

in the form of a linear or quadratic function. However, since rifling force generated by the designed rifling shows a maximum value locally, or a big rifling force appears at the time point when a projectile departs from the muzzle of a gun, the lifespan of the gun barrel or flight of the projectile may be negatively affected.

A method of expanding the rifling angle into a Fourier function has been proposed in order to improve the problems. However, if the rifling angle is expanded only into the Fourier function, convergence is guaranteed as the number of terms is increased, but it is disadvantageous in that boundary conditions cannot be satisfied. That is, since the convergence is processed only within the boundary conditions, there is no way to process the boundary conditions at the start and end points of the rifling angle, and thus the boundary conditions are processed only randomly.

If the rifling angle is expanded into a polynomial function, it is advantageous in that given boundary conditions may be faithfully satisfied, but the convergence is not guaranteed although the number of terms is increased.

SUMMARY OF THE INVENTION

Accordingly, the present invention has been made in view of the above-mentioned problems occurring in the prior art, and it is an object of the present invention to provide a rifling angle calculating method capable of minimizing the maximum value of rifling force generated when a gun is fired.

Technical problems to be solved in the present invention are not limited to the technical problems described above, and unmentioned other technical problems will become apparent to those skilled in the art from the following descriptions.

To accomplish the above objects, according to an aspect of the present invention, there is provided a rifling angle calculating method, in which rifling angle α(x), i.e., a parameter of rifling force, is calculated by expanding the rifling angle into a mathematical expression shown below in order to minimize a maximum value of the rifling force generated between a projectile and rifling when the projectile moves along an inner surface of a gun barrel by gun barrel pressure.

$$\alpha(x) = \sum_{i=0}^{k} a_i x^i + \sum_{j=1}^{l} (b_j \cos(jf(x)) + c_j \sin(jf(x)))$$

Here, x denotes a distance along a length of the gun barrel axis from a gun breech, f(x) denotes a constant parameter, and $a_i$, $b_j$, and $c_j$ are constants.

At this point, f(x) may be $$\frac{\pi x}{(x_e - x_i)}.$$

Here, $x_i$ denotes a distance from a gun breech to the start point of rifling, and $x_e$ denotes a distance from the gun breech to the end point of rifling.

In addition, among the calculated rifling angles, a difference between rifling angle $\alpha(x_e)$ at the end point of the rifling and rifling angle $\alpha(x_i)$ at the start point of the rifling may be less than 5.5.

Meanwhile, the rifling angle may be formed in the gun barrel according to the rifling angle calculating method described above.

DETAILED DESCRIPTION OF THE PREFERRED EMBODIMENT

Rifling is a depressed and prominent part processed on the inner surface of a gun barrel in order to impart a spin to a projectile, which refers to a part protruding from the inner surface of the gun barrel. At this point, a hollow part formed by the protruding rifling is referred to as a rifling groove. An action force generated between the projectile and the rifling when the projectile moves along the inner surface of the gun barrel by gun barrel pressure p(x) is referred to as rifling force R(x) and can be theorized as shown in mathematical expression 2.

[Mathematical expression 2]

$$R(x) = \frac{4}{D^2}\frac{J_p}{m_p}\left[\frac{dy}{dx}P(x) + \frac{d^2y}{dx^2}v(x)^2 m_p\right]$$

Here, P(x) denotes action force generated by gun barrel pressure p(x), which is expressed as $$P(x) = p(x)\left(\frac{\pi}{4}D^2 + nbt\right),$$

where x denotes a distance along the length of the gun barrel from a gun breech, y denotes a shape of a rifling angle, D denotes a rifling slope, $m_p$ denotes mass of a projectile, $J_p$ denotes mass moment of inertia of a projectile, v(x) denotes speed of a projectile, n denotes the number of rifling grooves, b denotes width of a rifling groove, t denotes depth of a rifling groove, and $$\frac{dy}{dx}$$

denotes a twist rate which has a relation of mathematical expression 1 with a rifling angle α.

Like this, the rifling force may be expressed in terms of a rifling slope, mass of a projectile, action force of gun barrel pressure, speed of a projectile, mass moment of inertia of a projectile, a twist rate, and a rate of change of a twist rate. Accordingly, a curve of rifling force with respect to the length of a gun barrel is determined depending on the type of a projectile, and the rifling force may be changed by changing the twist rate, i.e., the rifling angle.

Figure 1:
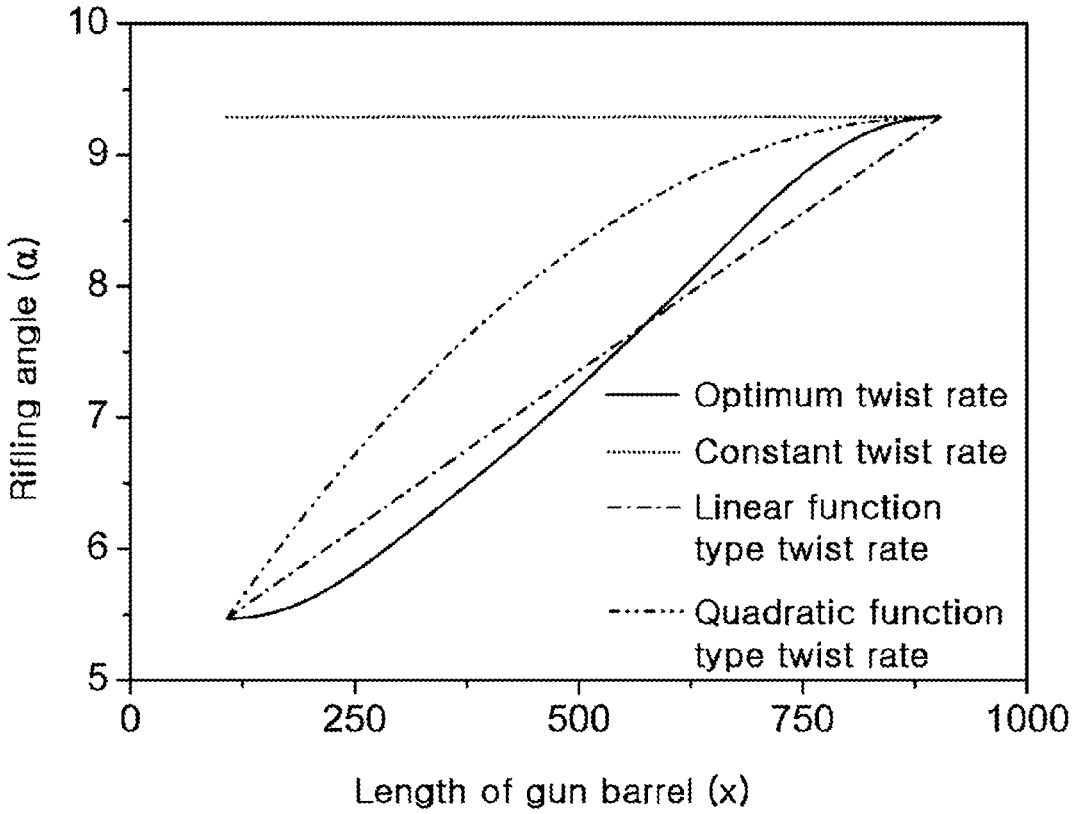
FIG. 1 is a graph showing the shape of rifling angles with respect to the length of a gun barrel of each twist rate.
Figure 2:
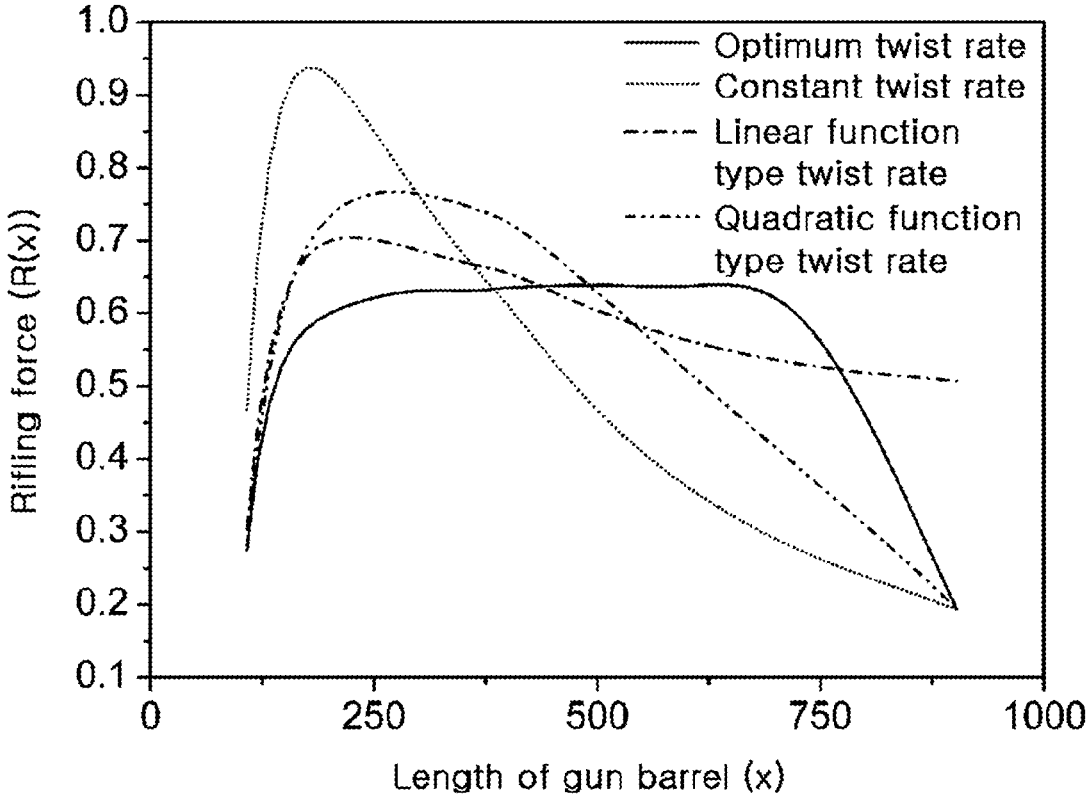
FIG. 2 is a graph showing rifling force of each twist rate.
Figure 3:
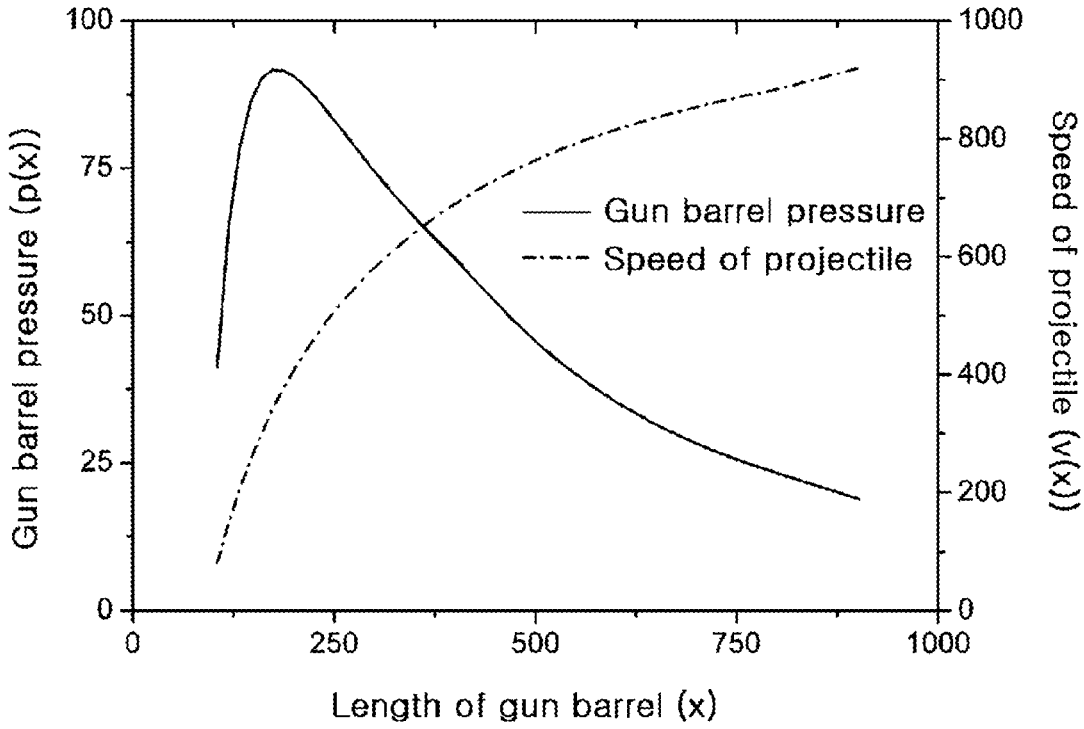
FIG. 3 is a graph showing the relation between gun barrel pressure and speed of a projectile.

FIG. 1 is a graph showing the shape of rifling angles with respect to the length of a gun barrel of each twist rate, FIG. 2 is a graph showing rifling force of each twist rate, and FIG. 3 is a graph showing the relation between gun barrel pressure and speed of a projectile. The portion showing a steady twist rate in the curve of rifling force of FIG. 2 exactly shows characteristics of the gun barrel pressure of FIG. 3, and thus it is understood that a locally concentrated load is generated at a certain portion of the gun barrel so as to negatively affect from the viewpoint of the lifespan of the gun barrel. In the case of a linear function type, a considerably magnificent rifling force is generated at the time point when a projectile departs from the gun barrel, and thus it may be determined that flight of the projectile will be affected thereby. In the case of a quadratic function type, it is confirmed that a further satisfactory result appears compared to the two cases described above. Like this, it may be expected that the maximum rifling force can be minimized by changing the twist rate, i.e., a shape of the rifling angle.

That is, the only thing to do is to obtain a rifling force having a smallest maximum value from numerous rifling force functions satisfying all restrictive conditions by determining a target to be minimized as "the maximum rifling force" and applying a numerical optimization technique that is already publicized. Since the rifling force R(x) is a function of a twist rate $$\left(\frac{dy}{dx}\right)$$

and the twist rate has a relation of mathematical expression 1 with the rifling angle α, the rifling force may be expressed as a function of rifling angle. Accordingly, the function of rifling angle, which is a variable, needs to be expanded in order to obtain a function of an optimum rifling force.

Generally, a function most frequently used in expanding a function of variables is a polynomial function or a Fourier function. The polynomial function faithfully satisfies given boundary conditions, but convergence is not guaranteed although the number of terms is increased. On the contrary, the Fourier function guarantees convergence furthermore as the number of terms is increased, but it does not satisfy the boundary conditions. In the present invention, in expanding a rifling angle as a function, a rifling angle function is defined through function expansion which takes only the advantages of the polynomial and Fourier functions by combining the two functions, thereby minimizing the rifling force, which is an objective function. Therefore, the boundary conditions at the start and end points of the rifling angle are faithfully satisfied, and an optimum rifling angle for minimizing the rifling force can be calculated.

Function expansion which takes only the advantages of the polynomial and Fourier functions by combining the two functions is performed in expanding the rifling angle, and the function combining the two functions is as shown in mathematical expression 3. In other words, in order to minimize the maximum value of the rifling force generated between a projectile and rifling when the projectile moves along the inner surface of the gun barrel by gun barrel pressure, rifling angle α(x), which is a parameter of the rifling force, may be calculated by expanding the rifling angle α(x) as shown below.

[Mathematical expression 3]

$$\alpha(x) = \sum_{i=0}^{k} a_i x^i + \sum_{j=1}^{l} (b_j \cos(jf(x)) + c_j \sin(jf(x)))$$

Here, x denotes a distance along the length of the gun barrel from a gun breech, f(x) denotes a constant parameter, and $a_i$, $b_j$, and $c_j$ are constants.

$$\frac{\pi x}{(x_e - x_i)},$$

mathematical expression 3 may be expressed as shown in mathematical expression 4.

[Mathematical expression 4]

$$\alpha(x) = \sum_{i=0}^{k} a_i x^i + \sum_{j=1}^{l} \left(b_j \cos\frac{j\pi x}{x_e - x_i} + c_j \sin\frac{j\pi x}{x_e - x_i}\right)$$

Here, $x_i$ denotes a distance from the gun breech to the start point of rifling, and $x_e$ denotes a distance from the gun breech to the end point of rifling.

Constant $a_i$ of the polynomial is expressed in terms of constants $b_j$ and $c_j$ of a Fourier function through restrictive conditions, and constant $a_i$ of the polynomial is obtained by calculating the Fourier function through an optimization program. Constant $a_i$ of the polynomial may be expressed as constants $b_j$ and $c_j$ of a Fourier function by applying both of two terms $$b_j \cos\frac{j\pi x}{x_e - x_i} \text{ and } c_j \sin\frac{j\pi x}{x_e - x_i}$$

constructing the Fourier function. Since any one of the terms may be removed without making a problem due to the characteristics of a harmonic function, the mathematical expression is expanded using only the first term for convenience sake.

Accordingly, constant $a_i$ of the polynomial may be expressed in terms of constants $b_j$ of a Fourier function through restrictive conditions shown below.

$$\alpha(x_e) = \alpha_e$$

$$\frac{d\alpha(x)}{dx} = 0 \text{ from } x = x_i$$

$$\frac{d\alpha(x)}{dx} = 0 \text{ from } x = x_e$$

$$\Delta\alpha \leq h^0$$

Here, $x_i$ denotes a distance to the start point of rifling, $x_e$ denotes a distance to the end point of rifling, and $\alpha_e$ denotes a rifling angle at the end point of rifling. The first restrictive condition represents a rifling angle at the end of the gun muzzle, which is used to restrict motions after a projectile departs from the gun barrel, and the second and third restrictive conditions are setting changes of the rifling angle to '0' in order to minimize changes of rifling force at the start and end points. The final restrictive condition is a term related to a band of a projectile, which is a condition for maintaining the function of the projectile band. That is, it is a condition for preventing loss of function caused by the change of plasticity resulting from the contact of the band attached on the outer surface of the projectile with the rifling when the projectile proceeds through the inner surface of the gun barrel. The final restrictive condition is a condition for confirming whether or not the rifling angle calculated through the optimization process is satisfied, which is not used in the process of deriving connectivity between constants of the polynomial function and constants of the Fourier function. Accordingly, if the polynomial constants are theorized by applying three restrictive conditions from the first, it is expressed as shown in mathematical expression 5.

[Mathematical expression 5]

$$a_1 = \frac{\pi}{(x_e - x_i)^2}\left[x_e\sum_{j=1}^{l} jb_j \sin\frac{j\pi x_i}{(x_e - x_i)} - x_i\sum_{j=1}^{l} jb_j \sin\frac{j\pi x_e}{(x_e - x_i)}\right]$$

$$a_2 = \frac{\pi}{2(x_e - x_i)^2}\left[\sum_{j=1}^{l} jb_j\left(\sin\frac{j\pi x_e}{(x_e - x_i)} - \sin\frac{j\pi x_i}{(x_e - x_i)}\right)\right]$$

$$a_0 = \alpha_e - a_1 x_e - a_2 x_e^2 - \sum_{j=1}^{l} b_j \cos\frac{j\pi x_e}{(x_e - x_i)}$$

If constant $a_i$ of the polynomial is converted into constant $b_j$ of the Fourier function and each constant $b_j$ of the Fourier function is obtained through a numerical optimization technique, the maximum rifling force may be minimized, and a rifling angle faithfully satisfying the restrictive conditions may be calculated.

Examples of constant terms of the polynomial and Fourier functions calculated as a result of the optimization performed on a gun system having rifling through the present invention are as shown below. Only ten constant terms of the Fourier function are used.

If constant terms of an optimized polynomial function are as shown in Table 1, constant terms of the optimized Fourier function are as shown in Table 2.

TABLE 1

| $a_0$ | $a_1$ | $a_2$ |
|---|---|---|
| 6.1241 | −0.4491 | −0.0032 |

TABLE 2

| $b_1$ | $b_2$ | $b_3$ | $b_4$ | $b_5$ |
|---|---|---|---|---|
| −2.1420 | −0.0116 | 0.0174 | −0.0339 | 0.0366 |
| $b_6$ | $b_7$ | $b_8$ | $b_9$ | $b_{10}$ |
| 0.0026 | 0.0080 | 0.0029 | −0.0004 | −0.0015 |

Curves of rifling angle and rifling force finally calculated using the tables are shown in FIGS. 1 and 2 (displayed as an optimum twist rate (solid line)).

Observing the figures, it may be confirmed that boundary condition at the start and end points of the rifling angle are faithfully satisfied and the maximum rifling force is reduced compared with those of the other methods.

Meanwhile, among the calculated rifling angles, a difference between rifling angle $\alpha(x_e)$ at the end point of rifling and rifling angle $\alpha(x_i)$ at the start point of rifling may be less than 5.5, and thus the projectile band may be protected. This may be theeorized as shown in mathematical expression 6.

$$\Delta a = a_e - a_i < 5.5° \quad \text{[Mathematical expression 6]}$$

Here, $\alpha_e$ is a rifling angle at the end point of rifling, and $\alpha_i$ is a rifling angle at the start point of rifling.

Meanwhile, rifling may be form inside a gun barrel based on the rifling angle calculated by the mathematical expressions described above. The maximum value of the rifling force applied to a fired projectile is reduced in the gun barrel where the rifling is formed like this, and thus damages on the projectile and inside of the gun barrel may be prevented. As a result, the gun barrel may be used for a further extended period of time, and flight performance of the projectile may be reliably guaranteed. Furthermore, since the projectile band is protected, the projectile may normally fly.

The present invention may be applied to a variety of gun barrels used for firing projectiles. Particularly, it is advantageous to apply the present invention to design and manufacture gun barrels that should faithfully satisfy restrictive conditions.

As described above, the rifling angle calculating method according to the present invention expands a rifling angle by combining a Fourier function and a polynomial function to take only the advantages of the two functions, and thus boundary conditions at the start and end points of the rifling angle may be faithfully satisfied, and an optimum rifling angle for minimizing the maximum rifling force may be calculated.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A rifling angle calculating method, in which rifling angle $\alpha(x)$, a parameter of rifling force, is calculated by expanding the rifling angle into a mathematical expression in order to minimize a maximum value of the rifling force generated between a projectile and rifling when the projectile moves along an inner surface of a gun barrel by gun barrel pressure, wherein the mathematical expression is $$\alpha(x) = \sum_{i=0}^{k} \alpha_i x^i + \sum_{j=1}^{l} (b_j \cos(jf(x)) + c_j \sin(jf(x))),$$

where x denotes a distance along the length of the gun barrel from a gun breech, f(x) denotes a constant parameter, and ai, bj, and cj are constants.

2. The method according to claim 1, wherein f(x) is $$\frac{\pi x}{(x_e - x_i)},$$

where xi denotes a distance from the gun breech to a start point of the rifling, and xe denotes a distance from the gun breech to an end point of the rifling.

3. A gun barrel formed with rifling having a rifling angle calculated according to claim 1.

4. A gun barrel formed with rifling having a rifling angle calculated according to claim 2.

* * * * *